US006513950B1

(12) United States Patent
Ono

(10) Patent No.: US 6,513,950 B1
(45) Date of Patent: Feb. 4, 2003

(54) SIGNAL LAMP HAVING LEDS, LENS, AND REFLECTORS AND RELATED METHOD OF USE

(75) Inventor: Masato Ono, Sagamihara (JP)

(73) Assignee: Stanley Electronic Co., Ltd., Tokyo (JP)

( * ) Notice: Subject to any disclaimer, the term of this patent is extended or adjusted under 35 U.S.C. 154(b) by 0 days.

(21) Appl. No.: 09/534,011

(22) Filed: Mar. 24, 2000

(30) Foreign Application Priority Data

Mar. 26, 1999 (JP) ..... 11-083203

(51) Int. Cl.[7] ..... F21V 7/00

(52) U.S. Cl. ..... 362/247; 362/241; 362/231; 362/293; 362/800

(58) Field of Search ..... 362/247, 241, 362/230, 231, 293, 800

(56) References Cited

U.S. PATENT DOCUMENTS 4,935,665 A * 6/1990 Murata ..... 313/500
5,313,729 A 5/1994 Sakai et al. ..... 40/452
5,571,277 A * 11/1996 Allred et al. ..... 362/459
5,642,933 A * 7/1997 Hitora ..... 362/243
5,785,418 A * 7/1998 Hochstein ..... 362/373
5,833,355 A * 11/1998 You et al. ..... 362/244

FOREIGN PATENT DOCUMENTS

EP 0 202 335 B1 10/1989

* cited by examiner

*Primary Examiner*—Sandra O'Shea
*Assistant Examiner*—Ronald E. DelGizzi
(74) *Attorney, Agent, or Firm*—Morgan, Lewis & Bockius LLP

(57) ABSTRACT

A signal lamp and method of use are disclosed in which reflectors are provided for the lamp's LEDs so that light from the LEDs can be utilized and directed in an effective manner. The signal lamp permits the number of LEDs to be reduced, costs to be lowered, and the amount of heat output by the LEDs to also be reduced. Prismatic cuts in the lens are also relatively simple, and the lens can be made thin because light distribution can be carried out by the LEDs and reflectors provided in the vicinity of the LEDs.

24 Claims, 4 Drawing Sheets

SOLID VIEW OF CUT SECTION

DETAIL F (a)

NARROW DIRECTIVITY LED

Fig. 6 (b) RELATED ART

WIDE DIRECTIVITY LED

SECTION B - B

BASIC SHAPE OF PRISMATIC CUTS

SIGNAL LAMP HAVING LEDS, LENS, AND REFLECTORS AND RELATED METHOD OF USE

The invention claims the benefit of Japanese patent application No. HEI 11-083203, filed on Mar. 26, 1999.

BACKGROUND OF THE INVENTION

1. Field of the Invention

The invention relates to a signal lamp, and more particularly relates to a structure for a traffic signal lamp employing a prescribed reflector for LEDs that has narrow directivity and substantial luminous intensity and which is configured in such a manner that an even light distribution can be attained with relatively few LEDs.

2. Description of the Related Art

FIG. 4 shows an example of a related traffic signal lamp 41. The traffic signal lamp 41 has a lens 42 located at a front surface of the lamp 41 and has a plurality of LEDs 44 on a substrate 43 provided at the rear of the lens 42. When a voltage is applied to the LEDs 44, light from the LEDs 44 is emitted, and the traffic signal lamp 41 functions as a traffic signal. A housing covering the substrate is also provided so that rainwater or dust does not enter the substrate on which the LEDs are arranged. The housing and lens are then welded or adhered together (not shown in the drawings).

The LEDs 44 in this type of traffic signal lamp 41 are illuminated as necessary so as to notify drivers of vehicles and pedestrians etc., and the lens may also be given a color or particular design. Information may be communicated, as necessary, using the colors and/or the manner of displaying the light.

As shown in the example in FIG. 5, light is distributed downward from a horizontal line because such a traffic signal lamp is usually provided above the drivers of vehicles, or pedestrians etc. Moreover, the light distribution due to the signal lamp is such that luminous intensity is high just below the horizontal line and falls off as the light proceeds downwards and spreads out over a wide range.

Conventionally, two types of LEDs are used, as shown in FIG. 6. One LED has narrow directivity, and high luminous intensity (FIG. 6*a*) and the other has wide directivity and low luminous intensity (FIG. 6*b*). The required light distribution can then be obtained by combining these two types of LEDs as appropriate. There are, however, many cases where the required light distribution cannot be obtained using only LEDs. Therefore, it is necessary to provide prismatic cuts on an outer lens or to provide an inner lens between the LEDs and the outer lens, as shown in FIG. 6(*b*).

The prismatic cuts at the front surface of the lens are not exactly the same and include, for example, combinations of relatively thick, narrow prismatic cuts 7*a* for portions which provide a light distribution of a high luminous intensity, and relatively shallow, broad prismatic cuts 7*b* for portions which provide a light distribution of a low luminous intensity, as shown in FIGS. 7(*a*)–(*d*).

However, although the light rays of the LEDs have some amount of directivity, light is also dispersed in a lateral direction due to the shape of the lenses of the LEDs and the shape of the horn on which the LED chips are mounted. Accordingly, only approximately 50% of the light is used in an effective manner. It is therefore necessary to increase the number of LEDs in order to obtain the required amount of light.

Increasing the number of LEDs also increases the amount of heat generated. It is therefore necessary to make the entire traffic signal lamp a certain amount thicker or to provide a heat sink (not shown) at the rear surface of the traffic signal lamp in order to ensure that heat does not accumulate within the traffic signal lamp.

When prismatic cuts are formed in the outer lens or when an inner tens is employed, light attenuation occurs within the lens, with the further inconvenience that the lens itself will become heavier due to being thicker. The combination of relatively deep, narrow prismatic cuts in the high luminous portion of the lens, and the relatively shallow, wide prismatic cuts in the low luminous portion of the lens results in a relatively complex lens.

In summary, only about 50% of light from the LEDs is utilized in related traffic signal lamps, requiring the number of LEDs used to be large. Thus, the conventional LED type lamps are expensive, and the amount of heat output by the LEDs is high, creating a major problem. In addition, the prismatic cuts in a lens placed over the related art signal lamp are often complex, the lamp thickness is often substantial, and the lens is usually relatively heavy.

SUMMARY OF THE INVENTION

According to the invention, a signal tamp having a lens at a front surface and an LED mounted on a substrate to the rear of the front lens can comprise a first reflector provided above the LED and extending forward substantially parallel to an optical axis of the LED, and a second reflector provided below the LED, and facing forward and inclined downwards with respect to the optical axis of the LED.

The desired light distribution can therefore be obtained with fewer LEDs by using direct light from LEDs of narrow directivity located at positions where luminous intensity directly below a horizontal line is to be high, and then obtaining reflected light using reflectors that reflect light at a low luminous intensity in a downward direction but which spread light over a wide area.

In accordance with another aspect of the invention, a signal lamp can be provided that includes a housing having a front surface and a back surface, a lens located adjacent the front surface of the housing, an LED located adjacent one of the lens and having housing, and reflector means located adjacent the LED for directing light emitted from the LED towards a predetermined position.

In the invention, it is not necessary to use a complex prismatically cut lens because light distribution is basically performed by the LEDs and reflectors provided in the vicinity of the LEDs.

It is to be understood that both the foregoing detailed description and the following general description are exemplary and explanatory and are intended to provide further explanation of the invention as claimed.

DETAILED DESCRIPTION OF THE PREFERRED EMBODIMENTS

The preferred embodiments of the invention will be described with reference to the drawings.

Figure 1A:
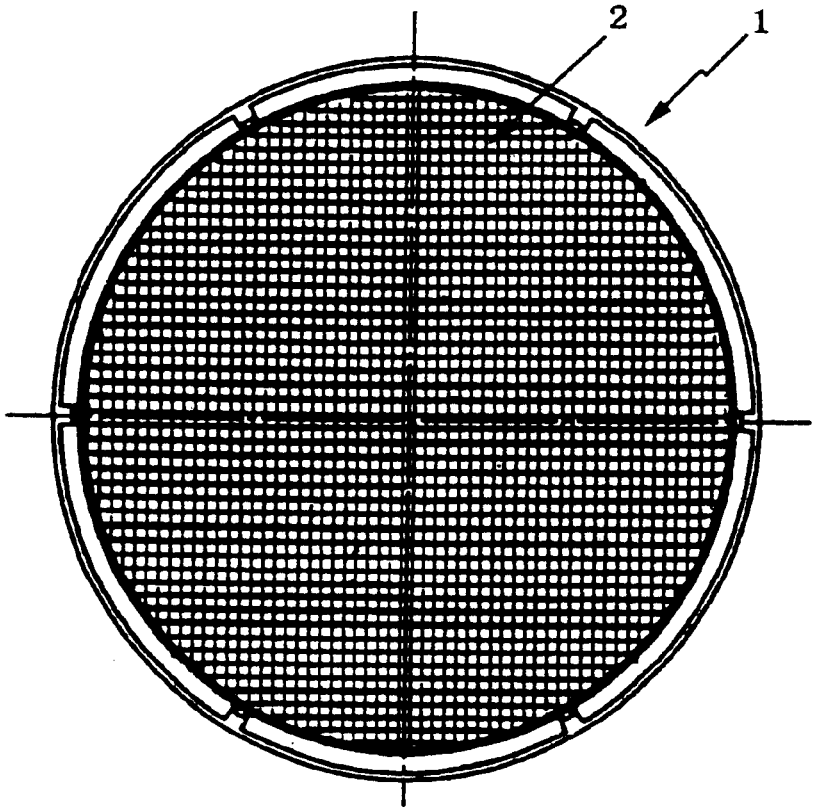
FIGS. 1(*a*) and (*b*) are front and side views, respectively, of a traffic signal lamp made in accordance with the principles of the invention.
Figure 1B:
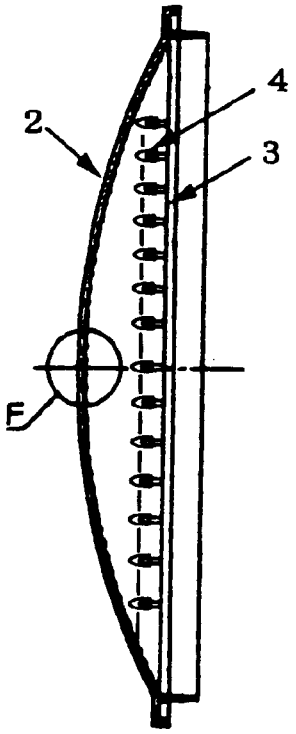

FIG. 1 shows a traffic signal lamp 1 made in accordance with the principles of the invention. A lens 2 can be provided at a front surface of the traffic signal lamp and a plurality of LEDs 4 can be provided, mounted on a substrate 3, at the rear of the lamp. Reflectors 5*a* that extend forward and substantially parallel to the optical axis of the LEDs 4 can be provided above each LED 4. Reflectors 5*b* extending forward and inclined downwards with respect to the optical axis of the LEDs 4 can be provided below the LEDs 4.

The LEDs can produce red, green or amber light as the signal requires or can be colorless LEDs, depending on the application. Colored pigment can also be employed at the lens and/or at an inner lens. Alternatively, the lens itself may be colored, or the LEDs may be colored or not colored. Accordingly, prismatic cuts do not have to be as complex as in related signal lamps.

Figure 2:
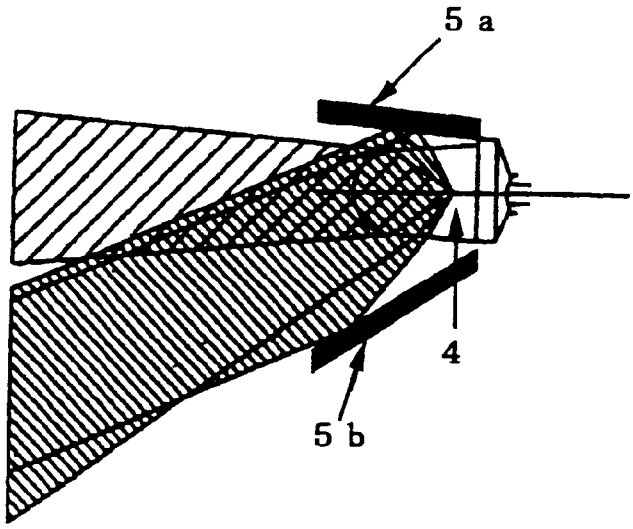
FIG. 2 is a cross-sectional view of an LED and reflector of the signal lamp of FIG. 1.
Figure 3A:
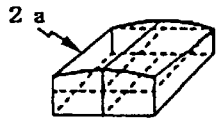
FIGS. 3(*a*)–3(*b*) are a perspective view and a cross-sectional view, respectively, of prismatic cuts of the signal lamp of FIG. 1.
Figure 3B:
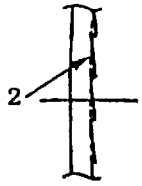
Figure 4A:
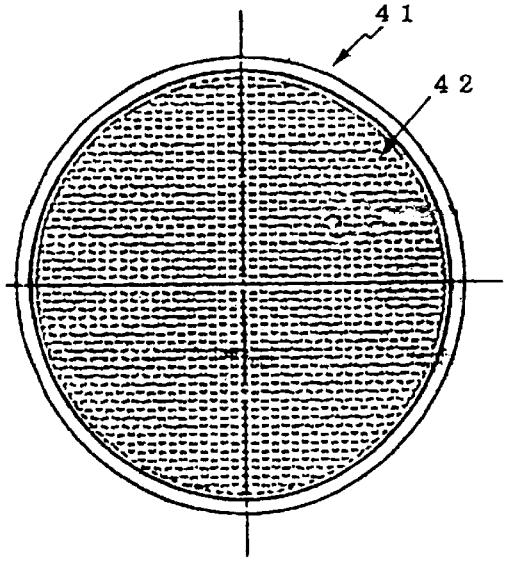
Fig. 4(a) RELATED ART
FIGS. 4(*a*)–(*c*) are front, side, and close-up views, respectively, of a conventional traffic signal lamp.
Figure 4B:
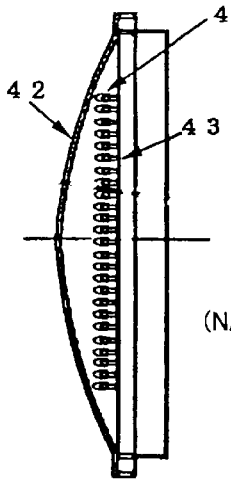
Fig. 4(b) RELATED ART
Figure 4C:
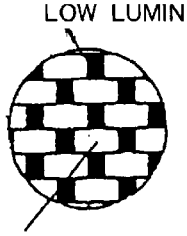
Fig. 4(c) RELATED ART
Figure 5:
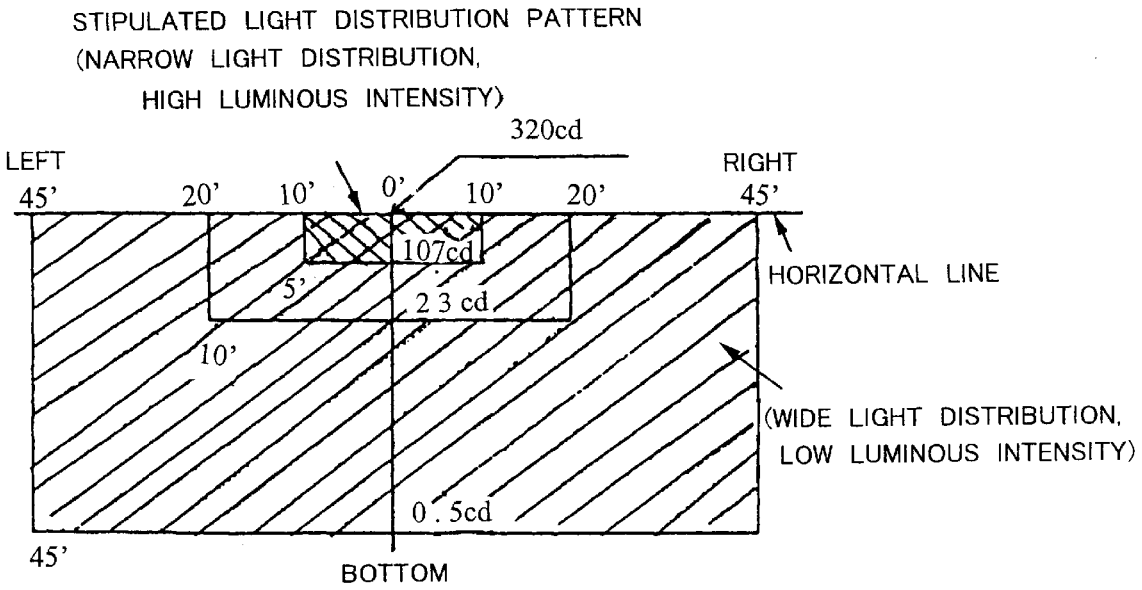
Fig.5 RELATED ART
FIG. 5 is a light distribution pattern for a conventional traffic signal lamp.
Figure 6A:
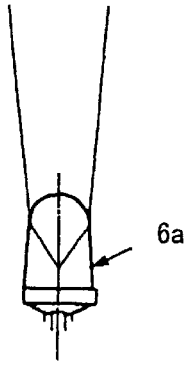
Fig. 6(a) RELATED ART
FIGS. 6 (*a*) and (*b*) are side views of a conventional narrow directivity LED and a conventional wide directivity LED, respectively.
Figure 6A:
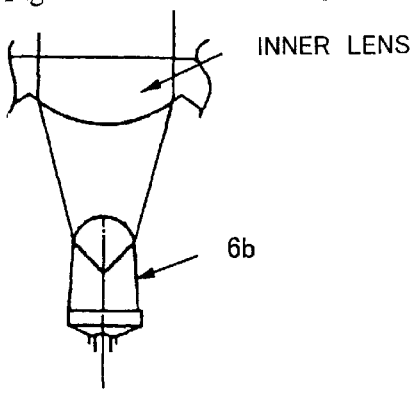
Fig. 6(a) RELATED ART
Figure 7A:
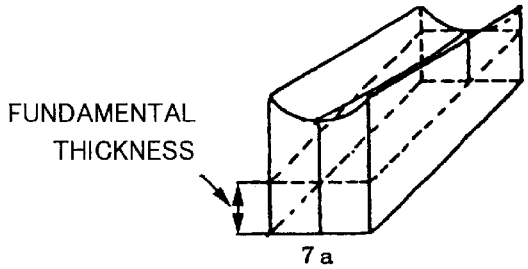
Fig. 7(a) RELATED ART
FIGS. 7 (*a*)–(*d*) are a first isometric view, a second isometric view, a first cross-sectional view and a second cross-sectional view along line B—B of FIG. 7(*c*), respectively, of conventional art lenses including prismatic cuts.
Figure 7B:
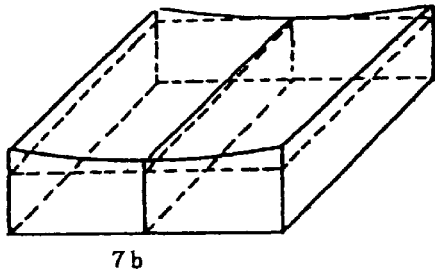
Fig. 7(b) RELATED ART
Figure 7C:
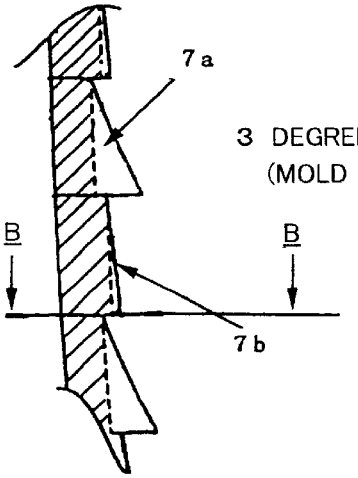
Fig. 7(c) RELATED ART
Figure 7D:
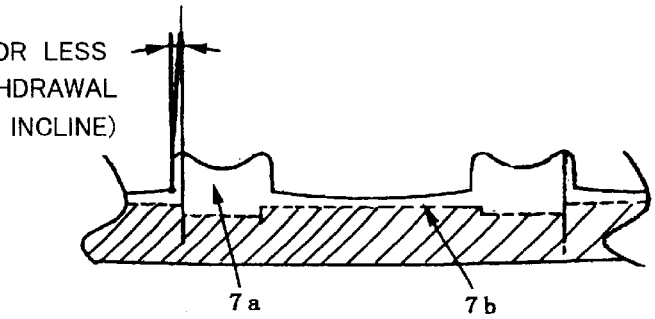
Fig. 7(d) RELATED ART

As shown in FIG. 2, the LEDs emit light as necessary to carry out illumination. However, the LEDs used here have narrow directivity and high luminous intensity. The front surface of the LEDs has a high luminous intensity as a result of direct light, and illuminates a high luminous intensity area located directly below the horizontal line of the illumination pattern (as shown in FIG. 5).

The light from each LED 4 that does not travel in the direction of the front surface of the LED is reflected by a reflector 5*a* provided above the LED 4 such that the light travels in a direction downwards from the LED 4. This reflected light is then partially reflected by a reflector 5*b* provided below the LED 4, with the partially reflected light also traveling in a direction downwards from the LED 4. Luminous intensity in a direction downwards and directly below the horizontal line may be LED, but illumination is wide due to this light.

Light distribution is basically performed by the LEDs and reflectors provided in the vicinity of the LEDs. The prismatically cut lens therefore only requires shallow, semi-cylindrical prismatic cuts. Complex, deep cuts typically used in the related art are no longer required. The prismatic cuts are used to assist light distribution, and to prevent the possibility of the interior of the signal lamp becoming visible through the lens.

In FIG. 2, LEDs 4 are used as the light source, and reflectors 5*b* are provided below the LEDs 4. Direct light from the LEDs 4 can therefore appear to be insufficient—but this is not the case because a large number of LEDs are provided and the lens plays a part in diffusing the light.

The LEDs themselves can also include lens portions and posses directivity. Alternatively, it is also possible, when an LED chip is used, to cover the LED chip with protective resin.

The traffic signal lamp (which has a lens at a front surface and a plurality of LEDs mounted on a substrate to the rear of the front lens) can include first reflectors provided above each LED and extending forward in a manner substantially parallel to an optical axis of the LEDs, and second reflectors provided below each LED, facing forward and inclined downwards with respect to the optical axis of the LEDs. Accordingly portions directly below the horizontal line (where the luminous intensity is high but narrow) are illuminated by direct illumination from the LEDs, and light which was not employed in the related art can now be utilized by the reflectors.

For the above reasons, it is possible to provide a signal lamp capable of at least the same degree of luminous intensity and light distribution as the related art, but which employs fewer LEDs. As a result, the amount of heat generated internally is reduced, the overall thickness of the signal lamp can be made thinner, and heat sinks etc. are no longer necessary.

Because light distribution is basically carried out by the LEDs and the reflectors provided in the vicinity of the LEDs, the prismatic cuts in the lens are simple as compared to the conventional art lamps, the lamp is also relatively thin overall, the manufacture of the lens and metal patterning is straightforward, and the lamp is relatively light in weight.

It should be understood that various modifications of the signal lamp can be made without departing from the scope of the invention. For example, the size of the reflectors and the material from which they are made can differ significantly. The reflectors can be non-reflective plastic with a reflective coating, e.g., silver or white coating, or they can be made from reflective materials including reflective plastics, metals, etc.

What is claimed is:

1. A signal lamp having a lens at a front surface and an LED mounted on a substrate at a rear of the front lens, said signal lamp comprising:

a first reflector provided above the LED and extending forward at a first angle with respect to an optical axis of the LED; and a second reflector provided below the LED, extending forward and inclined downwards and at a second angle that is different from said first angle with respect to said optical axis of the LED.

2. The signal lamp of claim 1, wherein the LED has narrow directivity and high luminous intensity.

3. The signal lamp of claim 1, wherein the LED has narrow directivity and high luminous intensity, and the LED is colored.

4. The signal lamp of claim 1, wherein the LED has narrow directivity and high luminous intensity, and the lens is colored.

5. The signal lamp of claim 1, wherein the LED has narrow directivity and high luminous intensity, and the LED and lens are colored.

6. The signal lamp of claim 1, wherein the signal lamp includes a plurality of LEDs.

7. The signal Lamp of claim 6, wherein said signal lamp includes a plurality of first reflectors and second reflectors, and each of said plurality of LEDs is located adjacent one of said plurality of first reflectors and one of said plurality of second reflectors.

8. The signal of claim 7, wherein one of the LED and lens is colored.

9. A signal lamp, comprising:

a housing having a front surface and a back surface;

a lens located adjacent said front surface of said housing;

an LED located adjacent one of said lens and said housing, and having an optical axis; and reflector means located adjacent said LED for directing light emitted from said LED towards a predetermined position that is not aligned with the optical axis of said LED such that the light emitted from the LED is distributed in a pattern that is not symmetrical abut the optical axis of the LED.

10. The signal lamp of claim 9, wherein said LED is colored.

11. The signal lamp of claim 9, wherein said lens is colored.

12. The signal lamp of claim 9, wherein the signal lamp includes a plurality of LEDs.

13. The signal lamp of claim 9, wherein said reflector means includes a first reflector located above said LED and a second reflector located below said LED.

14. The signal lamp of claim 13, wherein said first reflector is substantially parallel to an optical axis of said LED.

15. The signal lamp of claim 13, wherein said second reflector extends outward and away from said optical axis of said LED.

16. A method for emitting light from a signal lamp, the signal lamp including a housing having a front surface and a back surface, a lens located adjacent the front surface of the housing, an LED located adjacent one of the lens and the housing, and having an optical axis, and a reflector located adjacent the LED, comprising the steps of:

providing an electric current to the LED causing the LED to emit light; and directing said light emitted from the LED towards a predetermined position that is not aligned with the optical axis of said LED such that the light emitted from the LED is distributed in a pattern that is not symmetrical about the optical axis of the LED.

17. The method of claim 16, wherein said step of directing includes providing a first reflector above the LED and directing said light emitted from the LED towards said predetermined position via said first reflector.

18. The method of claim 17, wherein said step of directing includes providing a first reflector that is oriented substantially parallel to an optical axis of the LED.

19. The method of claim 17, wherein said step of directing includes providing a second reflector below the LED and directing said light emitted from the LED towards said predetermined position via said second reflector.

20. The method of claim 19, wherein said step of directing includes providing a second reflector that extends outward and downward from said optical axis of the LED.

21. The signal lamp of claim 1, wherein the first reflector reflects light that does not travel in a front direction of the LED such that the reflected light travels in a direction downwards from the LED, and the second reflector reflects light such that the reflected light travels in a direction downwards from the LED.

22. The signal lamp of claim 9, wherein the predetermined position is downwards from the LED.

23. The method of claim 16, wherein the predetermined position is downwards from the LED.

24. The signal lamp of claim 1, wherein the first reflector is substantially parallel to the optical axis of the LED.

* * * * *